US007726594B2

(12) United States Patent
Smith

(10) Patent No.: US 7,726,594 B2
(45) **Date of Patent: *Jun. 1, 2010**

(54) MULTI-FUNCTIONAL TOOL ASSEMBLY FOR PROCESSING TOOL OF MATERIAL PROCESSING MACHINE

(76) Inventor: Leward Nile Smith, 1341 SW. Dakle Rd., Lake City, FL (US) 32024-9358

( * ) Notice: Subject to any disclaimer, the term of this patent is extended or adjusted under 35 U.S.C. 154(b) by 141 days.

This patent is subject to a terminal disclaimer.

(21) Appl. No.: 11/702,452

(22) Filed: Feb. 5, 2007

(65) Prior Publication Data

US 2008/0061176 A1 Mar. 13, 2008

Related U.S. Application Data

(63) Continuation-in-part of application No. 11/416,806, filed on May 3, 2006, now Pat. No. 7,384,011, which is a continuation-in-part of application No. 11/042,590, filed on Jan. 25, 2005, now Pat. No. 7,121,485, which is a continuation of application No. 09/970,060, filed on Oct. 3, 2001, now Pat. No. 6,845,931.

(51) Int. Cl.
*B02C 13/288* (2006.01)

(52) U.S. Cl. ..... 241/55; 241/294

(58) Field of Classification Search ..... 241/55, 241/294

See application file for complete search history.

(56) References Cited

U.S. PATENT DOCUMENTS

| | | | |
|---|---|---|---|
| 190,675 | A | 5/1877 | Gaines |
| 589,236 | A | 8/1897 | Williams |
| 604,283 | A | 5/1898 | Albrecht |
| 787,290 | A | 4/1905 | Griffin |
| 1,266,894 | A | 5/1918 | Williams |
| 1,559,924 | A | 11/1925 | Willcox |
| 1,713,507 | A | 5/1929 | Ammon |
| 1,752,290 | A | 4/1930 | Ammon |
| 1,761,083 | A | 6/1930 | Liggett |
| 1,860,519 | A | 5/1932 | Wickersham |
| 1,889,129 | A | 11/1932 | Nielsen |
| 1,902,721 | A | 3/1933 | Reynolds |

(Continued)

FOREIGN PATENT DOCUMENTS

| | | |
|---|---|---|
| JP | 60-140645 | 9/1985 |

(Continued)

OTHER PUBLICATIONS

Wood Waste Disposal Problems: Bandit Has Some Anwers!, Bandit Industries, Inc. Hard Hat News, Oct. 22, 1993.

(Continued)

*Primary Examiner*—Mark Rosenbaum
(74) *Attorney, Agent, or Firm*—Paparella & Associates, PC; Joseph A. Paparella

(57) ABSTRACT

A multi-functional tool assembly for a material processing machine includes a single tool including a head and a shaft integrally formed therein. The head has a cavity with an arcuate surface. The multi-functional tool assembly also includes a material reducer adapted to reduce material within the waste processing machine. The material reducer is disposed in the cavity and has an arcuate surface complementary to the arcuate surface of the cavity.

20 Claims, 5 Drawing Sheets

U.S. PATENT DOCUMENTS

| | | | |
|---|---|---|---|
| 2,026,790 | A | 1/1936 | Mankoff |
| 2,128,194 | A | 8/1938 | Sheldon et al. |
| 2,244,577 | A | 6/1941 | Schreiber |
| 2,318,219 | A | 5/1943 | Harris |
| 2,392,958 | A | 1/1946 | Tice |
| 2,663,505 | A | 12/1953 | Sennholtz |
| 2,705,596 | A | 4/1955 | Poyser |
| 2,710,635 | A | 6/1955 | Alexander |
| 2,863,476 | A | 12/1958 | Clark |
| 2,864,420 | A | 12/1958 | Schmidt |
| 2,900,069 | A | 8/1959 | Manns et al. |
| 3,035,682 | A | 5/1962 | Ferch |
| 3,194,543 | A | 7/1965 | McIlvaine |
| 3,203,532 | A | 8/1965 | Mimnaugh et al. |
| 3,254,687 | A | 6/1966 | Tertyshnikov |
| 3,367,585 | A | 2/1968 | Ratkowski |
| 3,436,028 | A | 4/1969 | Koehnen et al. |
| 3,509,924 | A | 5/1970 | Newhouse, Jr. |
| 3,642,214 | A | 2/1972 | Blackwell, Jr. |
| 3,844,494 | A | 10/1974 | Hightower |
| 3,907,016 | A | 9/1975 | Nicholson et al. |
| 4,000,859 | A | 1/1977 | Whitney |
| 4,060,961 | A | 12/1977 | Anderson et al. |
| 4,074,594 | A | 2/1978 | Dall et al. |
| 4,076,177 | A | 2/1978 | Hirayama et al. |
| 4,077,450 | A | 3/1978 | Ackerman |
| 4,077,573 | A | 3/1978 | Kersey et al. |
| 4,117,985 | A | 10/1978 | Lazareck |
| 4,129,260 | A | 12/1978 | Baker |
| 4,129,262 | A | 12/1978 | Lowry |
| 4,146,184 | A | 3/1979 | Whitney |
| 4,146,185 | A | 3/1979 | Schober |
| 4,162,769 | A | 7/1979 | LaPointe |
| 4,162,770 | A | 7/1979 | Lewis |
| 4,168,035 | A | 9/1979 | Palm et al. |
| 4,344,581 | A | 8/1982 | Redemann |
| 4,504,019 | A | 3/1985 | Newell et al. |
| 4,558,826 | A | 12/1985 | Martinek |
| 4,573,643 | A | 3/1986 | Orphall et al. |
| 4,688,731 | A | 8/1987 | Hunt et al. |
| 4,702,424 | A | 10/1987 | Widlak |
| 4,717,083 | A | 1/1988 | Quast et al. |
| 4,848,681 | A | 7/1989 | Eriksson et al. |
| 4,850,406 | A | 7/1989 | Krautzberger |
| 4,872,500 | A | 10/1989 | Duffey et al. |
| 4,915,310 | A | 4/1990 | Stelk |
| 4,917,314 | A | 4/1990 | Manschwetus |
| 4,922,977 | A | 5/1990 | Colton et al. |
| 4,967,969 | A | 11/1990 | Griffith, III |
| 4,982,904 | A | 1/1991 | Greiner |
| 5,002,233 | A | 3/1991 | Williams |
| 5,042,727 | A | 8/1991 | Plante |
| 5,044,567 | A | 9/1991 | Hausler et al. |
| 5,078,328 | A | 1/1992 | Willingham |
| 5,114,085 | A | 5/1992 | Inui |
| 5,205,496 | A | 4/1993 | O'Donnell et al. |
| 5,209,278 | A | 5/1993 | Carpenter et al. |
| 5,285,974 | A | 2/1994 | Cesarini |
| 5,372,316 | A | 12/1994 | Bateman |
| 5,377,919 | A | 1/1995 | Rogers et al. |
| 5,381,971 | A | 1/1995 | Rehmer |
| 5,392,999 | A | 2/1995 | Konig et al. |
| 5,404,993 | A | 4/1995 | Scarrow |
| 5,413,286 | A | 5/1995 | Bateman |
| 5,435,689 | A | 7/1995 | Stonehouse |
| 5,474,239 | A | 12/1995 | Williams, Jr. et al. |
| 5,507,441 | A | 4/1996 | De Boef et al. |
| 5,526,988 | A | 6/1996 | Rine |
| 5,529,249 | A | 6/1996 | Braun et al. |
| 5,605,291 | A | 2/1997 | Doskocil |
| 5,611,496 | A | 3/1997 | Fleenor |
| 5,713,525 | A | 2/1998 | Morey |
| 5,743,314 | A | 4/1998 | Puch |
| 5,863,003 | A | 1/1999 | Smith |
| 5,938,129 | A | 8/1999 | Forsyth |
| 6,016,979 | A | 1/2000 | Squires et al. |
| 6,047,912 | A | 4/2000 | Smith |
| 6,059,210 | A | 5/2000 | Smith |
| 6,299,082 | B1 | 10/2001 | Smith |
| 6,517,020 | B1 | 2/2003 | Smith |
| 6,766,973 | B2 * | 7/2004 | Muri ..... 241/101.73 |
| 6,845,931 | B1 | 1/2005 | Smith |
| 7,007,874 | B1 | 3/2006 | Smith |
| 7,121,485 | B2 * | 10/2006 | Smith ..... 241/55 |
| 7,384,011 | B1 * | 6/2008 | Smith ..... 241/55 |
| 7,416,144 | B2 * | 8/2008 | Kammerer et al. ..... 241/197 |

FOREIGN PATENT DOCUMENTS

| | | |
|---|---|---|
| JP | 64-7960 | 1/1989 |
| JP | 1-65650 | 4/1989 |
| JP | 8-299825 | 11/1996 |

OTHER PUBLICATIONS

Bandit Inustries, Inc., Reader Card 218, Forest Publications, Timber West, Nov. 1993.
Bandit's Beast Maintains Nature's Beauty, Construction Equipment Guide, Jun. 1, 1994.
The Beast, Model 30 Grinding Yard Waste, Model 15, Grinding Housing Demolition, Waste Handling Equipment News, Sep. 1994.
Bandit Industries' Model 15-H Beast Recycler, Forest Products Equipment, Aug. 1994.
The Model 15 Beast, Bandit Industries, Inc., MSW Management, Mar./Apr. 1994.
Want to Lower the Cost of Breaking Down Yard and Other Landfill Waste? . . . Try the Beast from Bandit, Resource Recycling, Nov. 1994.
Turn Your Green Waste Into Green Dollars, Bandit Industries, Inc., Sportsturf, 1994.
"Product Release" for the new Model 15-H Beast Recycler Offered by Bandit Industries, Waste Handling Equipment New, Jun. 1994.
For Your Chipping and Grinding Needs, Bandit Industries, Inc., Forest Products Equipment, Aug. 1994.
Megagrind by Rexworks 800, 1995.
How to chop yard waste costs!, 1000 Commercial Grinder, Farmhand
The Beast, Model 15-h, Bandit Industries, Inc.
The Beast Recyclers from Bandit Industries . . . with Big Appetites for Waste, Bandit Industries.
The Beast—Coming in the Summer of 1993 from Bandit Industries, Inc.
Maxigrind by Rexworks, the Most Versitile Materials Processing Machine.
Industrial Grinder, Big Bite, Manufactured by Haybuster.

* cited by examiner

FIG 3
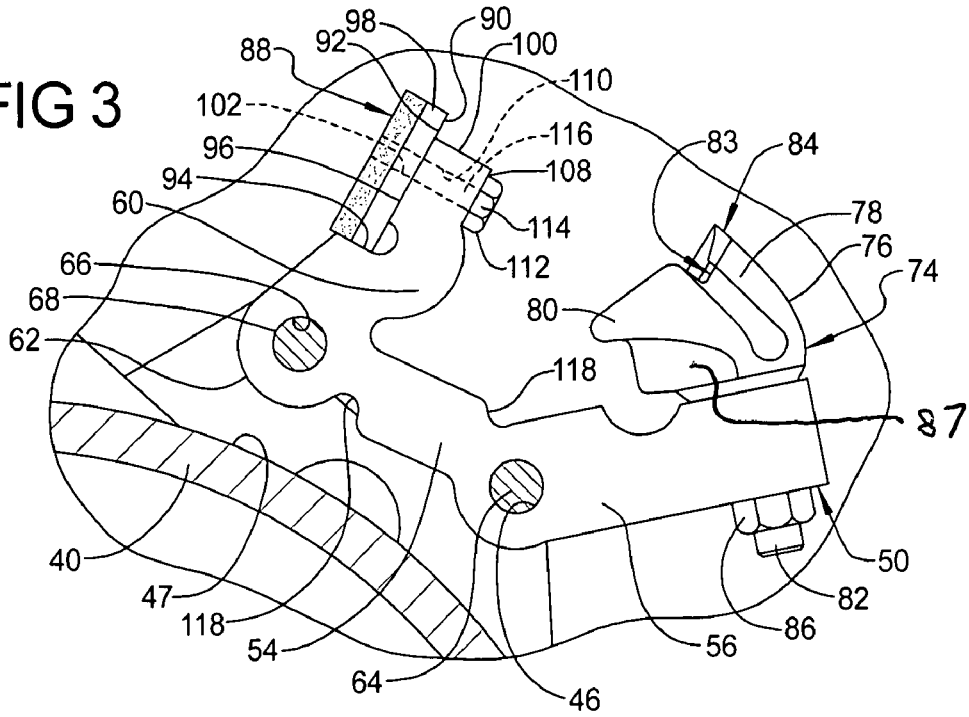
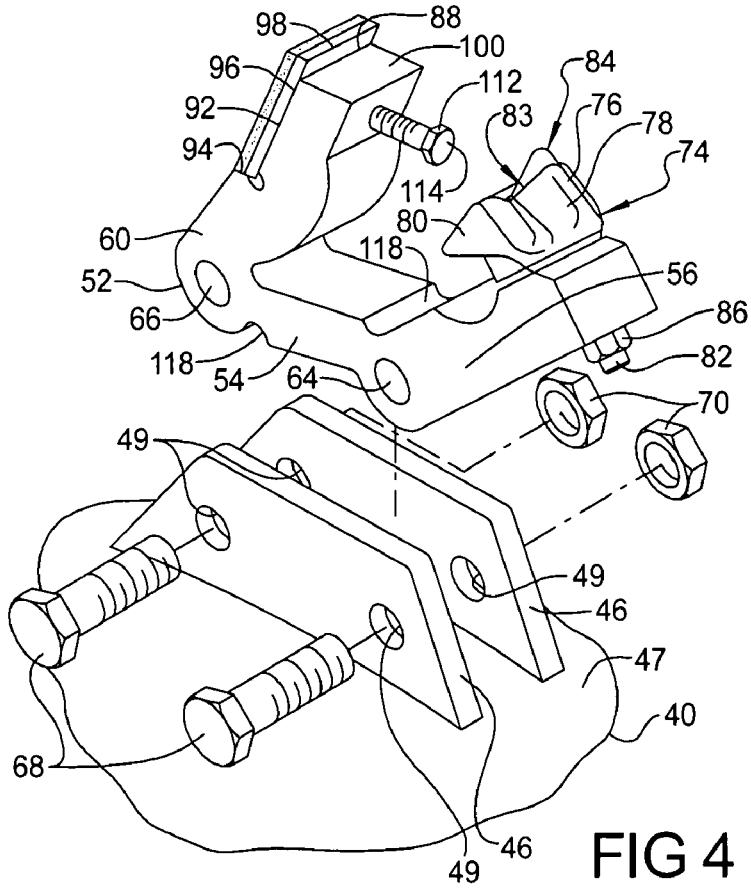
FIG 4

FIG 10
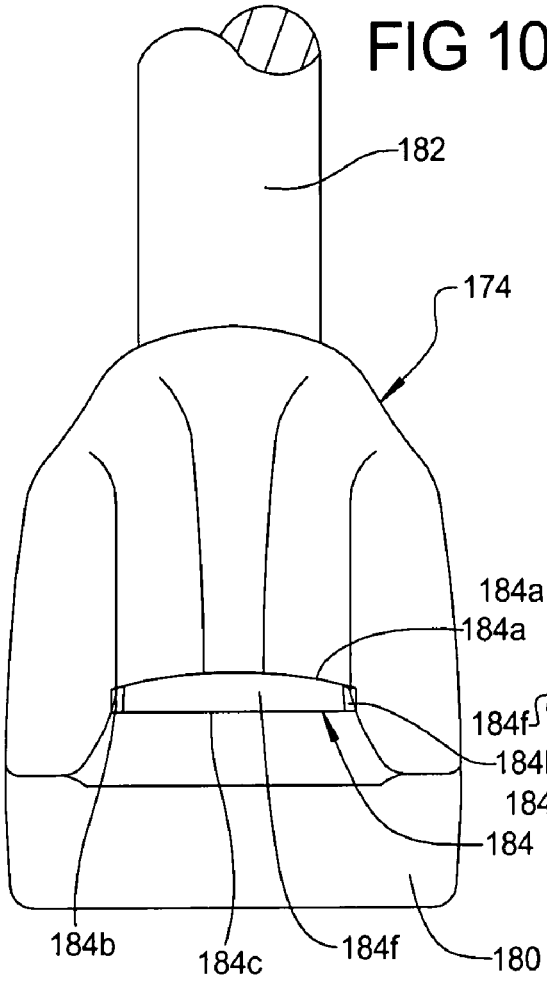
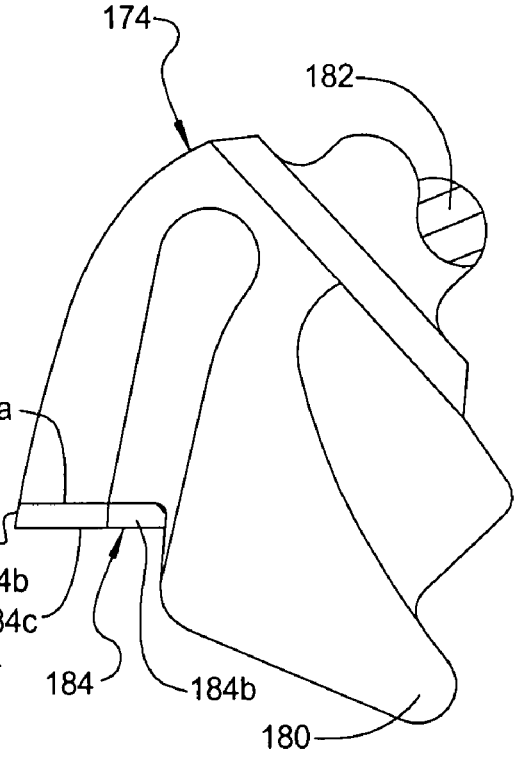
FIG 9
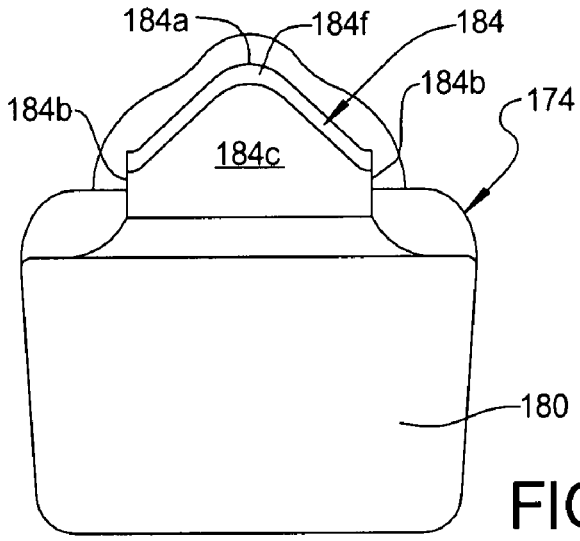
FIG 8

MULTI-FUNCTIONAL TOOL ASSEMBLY FOR PROCESSING TOOL OF MATERIAL PROCESSING MACHINE

CROSS-REFERENCE TO RELATED APPLICATION(S)

The present application is a continuation-in-part of U.S. application Ser. No. 11/416,806, filed May 3, 2006, now U.S. Pat. No. 7,384,011, which is a continuation-in-part of U.S. patent application Ser. No. 11/042,590, filed Jan. 25, 2005, now U.S. Pat. No. 7,121,485, which is a continuation of U.S. patent application Ser. No. 09/970,060, filed Oct. 3, 2001, now U.S. Pat. No. 6,845,931.

BACKGROUND OF THE INVENTION

1. Field of the Invention

The present invention relates generally to material processing machines and, more particularly, to a multi-functional tool assembly for a processing tool of a material processing machine.

2. Description of the Related Art

It is known to provide material processing machines to reduce materials such as a waste processing machine to reduce waste material. For a waste processing machine, the waste processing machine typically includes a rotor assembly for reducing the waste material as the rotor assembly rotates. An example of such a rotor assembly for a waste processing machine is disclosed in U.S. Pat. No. 5,863,003, issued Jan. 26, 1999, to Smith, entitled "WASTE PROCESSING MACHINE". In that patent, the rotor assembly includes a rotor having a plurality of spaced pairs of mounting arms. The rotor assembly also includes a processing tool mounted to each pair of mounting arms. An example of a processing tool is disclosed in U.S. Pat. No. 6,845,931, issued Jan. 25, 2005, to Smith, entitled "MULTI-FUNCTIONAL TOOL ASSEMBLY FOR PROCESSING TOOL OF A WASTE PROCESSING MACHINE". In that patent, the processing tool includes a tool holder attached to the mounting arms of the rotor assembly by fasteners. The tool holder has a pair of spaced arms extending radially with a tool for reducing waste product attached to one arm and a wear bar or raker for depth limiting guiding attached to the other arm. Typically, the tool has a head, a shaft, and a waste reducer attached to the head by suitable means such as brazing. The shaft of the tool is extended through an aperture in the arm of the processing tool and secured thereto by a fastener such as a nut.

In some applications, the force on the waste reducer may cause the brazing to give way and the waste reducer may become detached from the head. This is due to shear forces acting on the waste reducer. The shear forces produce a sideways force vector acting on either side of the waste reducer. This causes the brazing, which is in compression, to be tensioned and give way, which is undesired.

Therefore, it is desirable to provide a single multi-functional tool assembly in a material processing machine for reducing material and aggressively outputting the reduced material. It is also desirable to provide a multi-functional tool assembly for a material processing machine that reduces or eliminates the material reducer from disengaging the processing tool when reducing material. It is still further desirable to provide a multi-functional tool assembly that reduces or redirects the shear force vector acting on the material reducer. Therefore, there is a need in the art to provide a multi-functional tool assembly for a processing tool of a material processing machine that meets at least one of these desires.

SUMMARY OF THE INVENTION

It is, therefore, one object of the present invention to provide a multi-functional tool assembly for a processing tool of a material processing machine.

Accordingly, the present invention is a multi-functional tool assembly for a material processing machine. The multi-functional tool assembly includes a single tool including a head and a shaft integrally formed therein. The head has a cavity with an arcuate surface. The multi-functional tool assembly also includes a material reducer adapted to reduce material within the material processing machine. The material reducer is disposed in the cavity and has an arcuate surface complementary to the arcuate surface of the cavity.

One advantage of the present invention is that a multi-functional tool assembly is provided for a processing tool of a material processing machine. Another advantage of the present invention is that the multi-functional tool assembly is a single multi-functional tool that allows material to be reduced and aggressively outputs the reduced material from the rotor assembly in the material processing machine. Yet another advantage of the present invention is that the multi-functional tool assembly is that the multi-functional tool has a cavity with an arcuate surface for the material reducer to reduce or prevent the material reducer from disengaging the tool. Still another advantage of the present invention is that the multi-functional tool assembly has a cavity with an arcuate surface and the material reducer has a complementary arcuate surface to reduce or redirect the shear force vector acting on the tool.

Other objects, features, and advantages of the present invention will be readily appreciated, as the same becomes better understood, after reading the subsequent description when considered in connection with the accompanying drawings.

BRIEF DESCRIPTION OF THE DRAWINGS

FIG. 3 is an enlarged fragmentary elevational view of a processing tool, according to the present invention, of the rotor assembly in circle 3 of FIG. 2.

FIG. 4 is an exploded perspective view of the processing tool of FIG. 3.

FIG. 8 is an elevational front view of another embodiment, according to the present invention, of a multi-functional tool assembly of the processing tool of FIG. 4.

FIG. 9 is an elevational side view of the multi-functional tool assembly of FIG. 8.

FIG. 10 is a plan view of the multi-functional tool assembly of FIG. 8.

DESCRIPTION OF THE PREFERRED EMBODIMENT(S)

Figure 1:
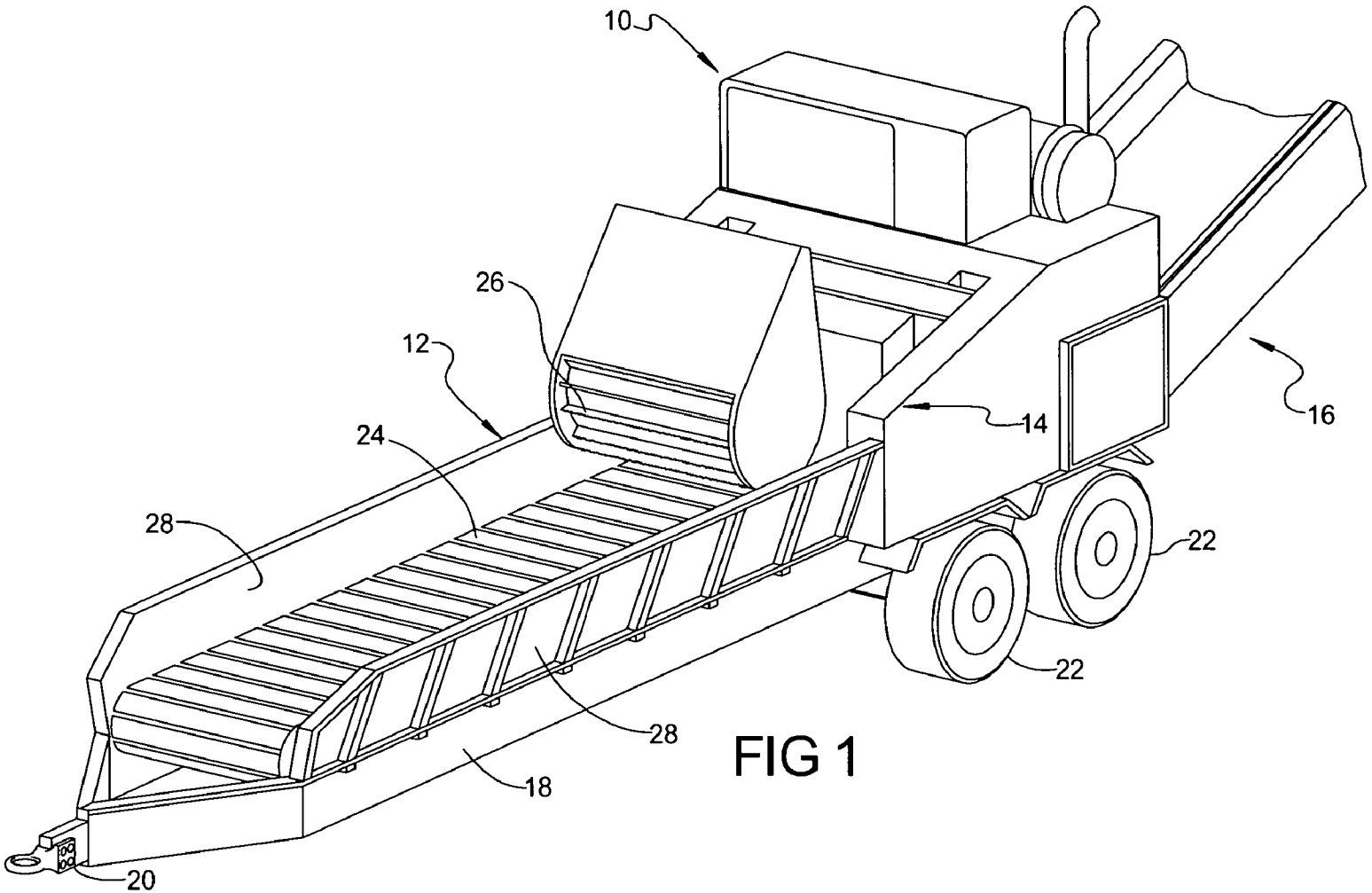
FIG. 1 is a perspective view of a material processing machine.

Referring now to the drawings and in particular to FIG. 1, one embodiment of a material processing machine 10 for reducing material is shown. The material processing machine 10 includes an infeed system 12, a material reducing system 14, and a discharge system 16. Material enters the material processing machine 10 through the infeed system 12 where it is directed to the material reducing system 14. The material reducing system 14 reduces the material and directs it to the discharge system 16 where the reduced material is expelled from the material processing machine 10. The material processing machine 10 may be supported on a trailer framework 18 having a tongue mount 20 provided at a front thereof and wheels 22 near a rear of the framework 18. It should be appreciated that, with this structure, the infeed system 12 and material reducing system 14 can be transported together while the discharge system 16 can be transported separately therefrom. It should also be appreciated that the material may take many forms and varieties such as waste, boards, roots, etc. and processed into different types such as waste, sawdust, wood chips, etc.

Figure 2:
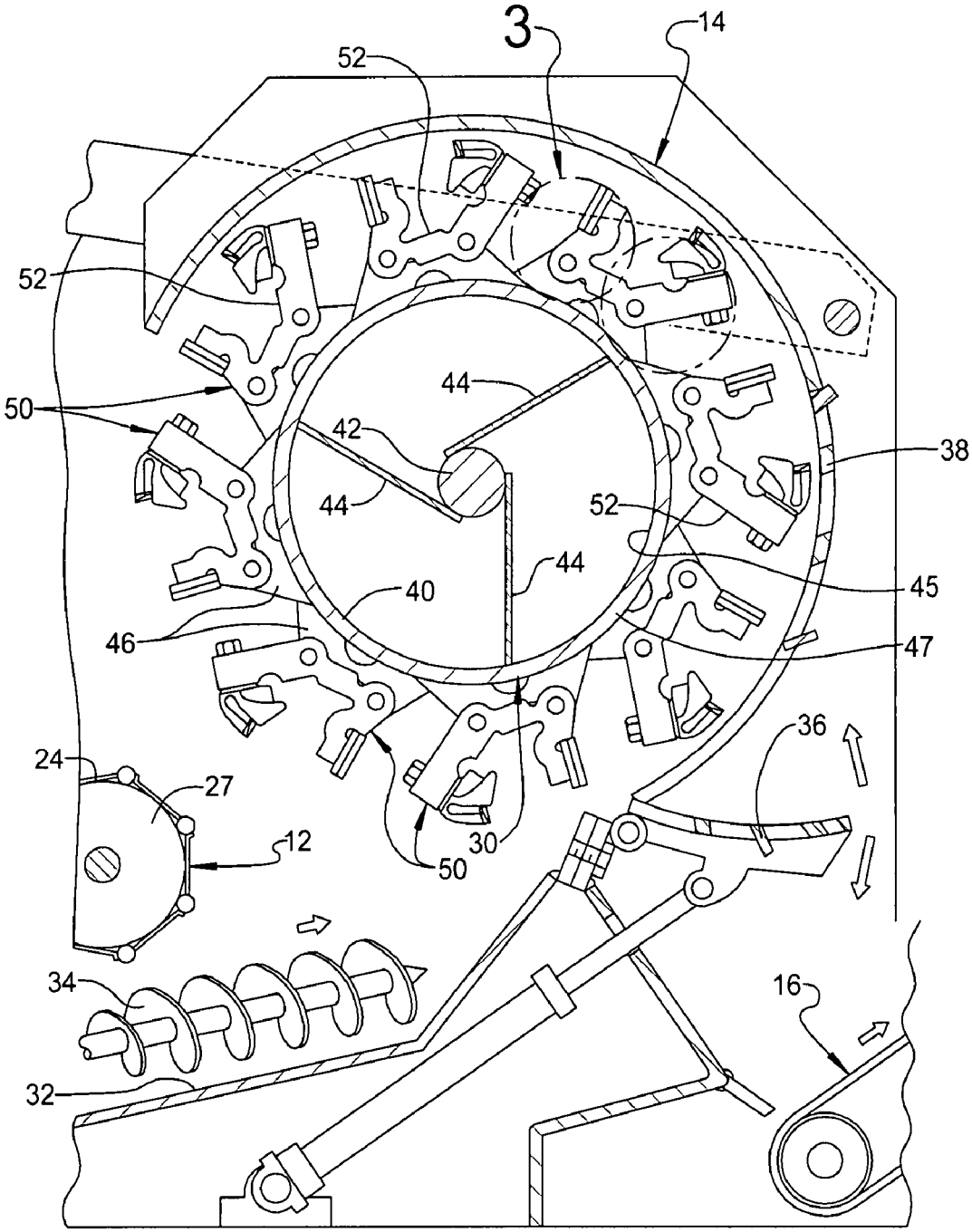
FIG. 2 is a fragmentary elevational view of a rotor assembly of the material processing machine of FIG. 1.
Figure 7:
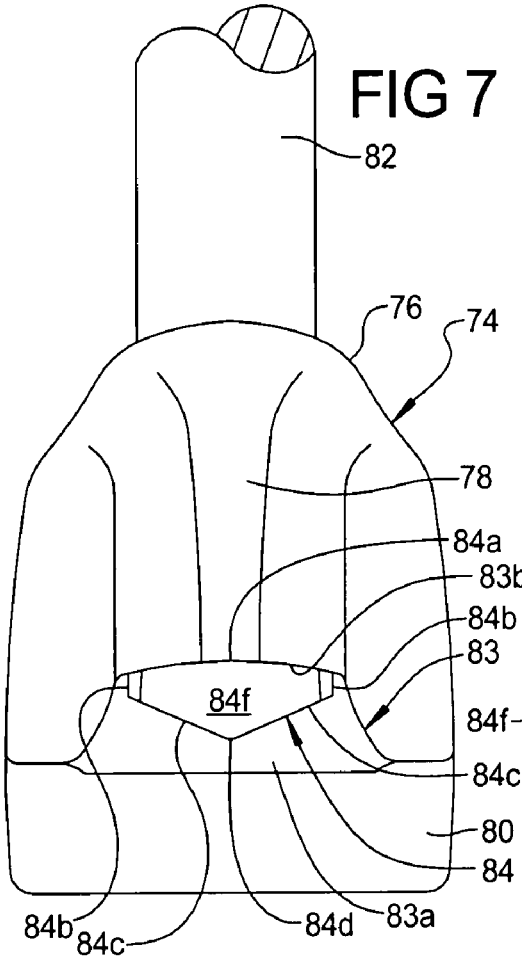
FIG. 7 is a plan view of the multi-functional tool assembly of FIG. 5.
Figure 6:
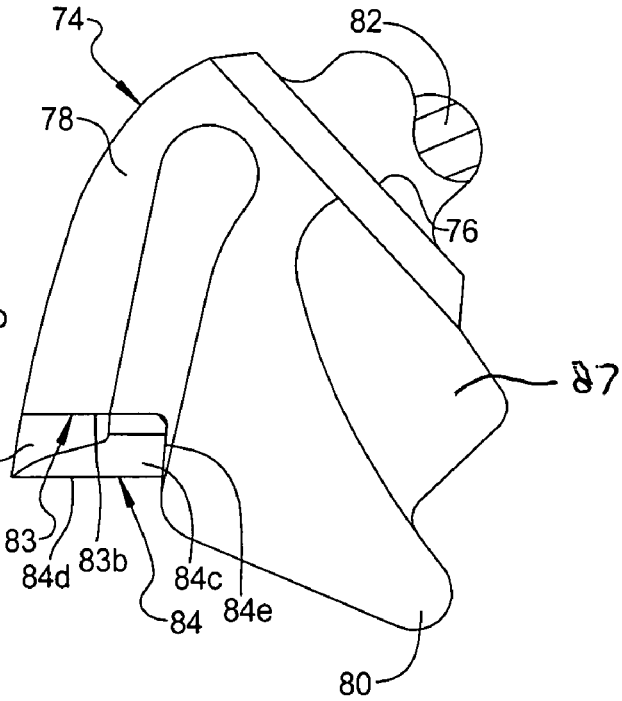
FIG. 6 is an elevational side view of the multi-functional tool assembly of FIG. 5.
Figure 5:
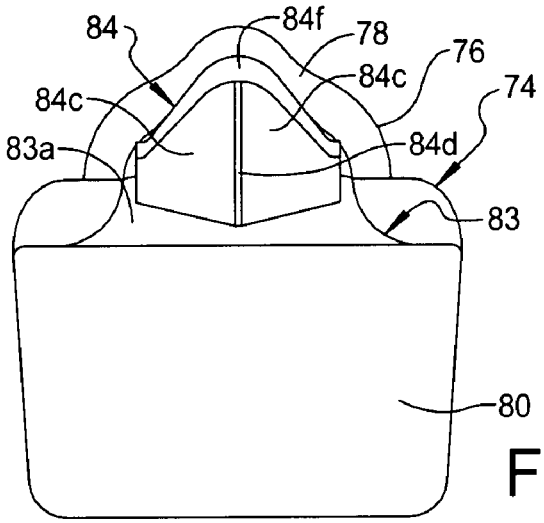
FIG. 5 is an elevational front view of a multi-functional tool assembly, according to the present invention, of the processing tool of FIG. 4.

Referring to FIGS. 1 and 2, the infeed system 12 includes an infeed conveyor 24 and a feed wheel assembly 26. The infeed conveyor 24 has a terminal end 27 spaced a predetermined distance such as one quarter inches (0.25 inches) from a rotor assembly 30 to be described of the material reducing system 14. The infeed conveyor 24 is the sole means of support for the material and acts as a primary anvil for reducing the material by the rotor assembly 30 to be described. Opposed side walls 28 are provided on opposite sides of the infeed conveyor 24 to contain the material. It should be appreciated that material is placed on the infeed conveyor 24, which moves the material into contact with the feed wheel assembly 26, which, in turn, rotates and feeds the material into contact with the rotor assembly 30 of the material reducing system 14.

Referring to FIGS. 2 and 3, the material reducing system 14 includes a rotor assembly, according to the present invention and generally indicated at 30. The material reducing system 14 also includes a housing 32 disposed about the rotor assembly 30 and a plurality of regrind augers 34 positioned at a bottom of the housing 32. The material reducing system 14 further includes a movable concave screen 36 and a fixed concave screen 38 at a rear of the housing 32. It should be appreciated that the material reducing system 14 reduces material by the rotor assembly 30, which passes through the screens 36,38 to the discharge system 16. It should also be appreciated that the regrind augers 34 move reduced material or product into contact with the rotor assembly 30 for further reduction to pass through the screens 36,38.

The rotor assembly 30 also includes a rotatable rotor 40 disposed within the housing 32 above the regrind augers 34. The rotor 40 is a generally cylindrical tube having a longitudinal axis. The rotor 40 is mounted to a coaxially disposed shaft 42 by multiple braces 44 extending tangentially from an outer surface of the shaft 42 to an inner surface 45 of the rotor 40. Preferably, each brace 44 is an elongated plate-like member fixed tangentially to the shaft 42 by suitable means such as welding and is similarly secured to the inner surface 45 of the rotor 40 by suitable means such as welding. It should be appreciated that a power source (not shown) is connected to the shaft 42 in a well-known manner and is adapted to turn the shaft 42 and rotor 40.

Referring to FIGS. 2 through 4, the rotor assembly 30 also includes a plurality of spaced pairs of mounting arms 46 mounted to an outer surface 47 of the rotor 40 by suitable means such as welding. Each mounting arm 46 is generally trapezoidal in shape and includes at least one, preferably a pair of spaced apertures 49 extending therethrough. The mounting arms 46 are wrapped about the rotor 40 in a first spiral and a second spiral spaced or offset from the first spiral. The rotor assembly 30 further includes a plurality of processing tools, according to the present invention and generally indicated at 50, mounted to the mounting arms 46. The first spiral and the second spiral of mounting arms 46 extend about the rotor 40 so that in one rotation of the rotor assembly 30, every point on an imaginary axial line segment positioned adjacent to the rotor assembly 30 will be contacted by the processing tools 50 mounted to the rotor assembly 30.

Each of the processing tools 50, according to the present invention, includes a tool holder 52 having a general "C" shape. The tool holder 52 has a body 54 extending circumferentially and a first or trailing arm 56 extending radially at an angle therefrom with a first aperture 58 extending therethrough. The tool holder 52 also includes a second or leading arm 60 extending radially at an angle from the body 54. The tool holder 52 includes an aperture 64 and 66 at a lower radial end of the first arm 56 and second arm 60, respectively, and extending axially therethrough. The body 54 has a width or thickness less than the first arm 56 and the second arm 60. The tool holder 52 is continuous, integral, unitary, and made as one-piece. It should be appreciated that the apertures 64,66 of the tool holder 52 are aligned with the apertures 49 of the mounting arms 46.

The rotor assembly 30 includes at least one, preferably a pair of fasteners such as bolts 68 and nuts 70 for retaining the processing tools 50 to the mounting arms 46. The bolts 68 extend through the apertures 49 in the mounting arms 46 and the apertures 64,66 of the tool holder 52 and threadably engage the nuts 70. It should be appreciated that the tool holder 52 is disposed between the mounting arms 46.

Referring to FIGS. 2 through 7, the processing tool 50 also includes a multi-functional tool assembly, generally indicated at 74 and according to the present invention, attached to the tool holder 52. The multi-functional tool assembly 74 includes a multi-functional tool 76 to aggressively intake the material, reduce the material, and aggressively output the reduced material by pushing the reduced material to the screens 36,38 and out of the rotor assembly 30.

The multi-functional tool 76 includes a head 78, fan 80, and shaft 82. The head 78, fan 80, and shaft 82 are made of a metal material and are made as a single forging. The head 78, fan 80, and shaft 82 are a monolithic structure being integral, unitary, and one-piece.

The multi-functional tool 76 also includes a cavity or pocket, generally indicated at 83, between the head 78 and the fan 80 to receive a material reducer 84 to be described. The cavity 83 includes a base wall 83*a*, which is generally planar, and extends laterally and longitudinally. The cavity 83 also includes a side wall 83*b*, which is generally arcuate in shape such as concave, and extending vertically or generally perpendicular to the base wall 83*a*. It should be appreciated that the cavity 83 is formed by a mill (not shown) that plunges into the forging in a secondary machining operation to machine the cavity 83 therein.

The multi-functional tool assembly 74 also includes a material reducer, generally indicated at 84, disposed in the cavity 83. In the embodiment illustrated, the material reducer 84 is a splitter to split or reduce the material. The material reducer 84 has a rear surface 84*a* that is generally arcuate in shape such as convex and extending laterally. The material reducer 84 also has a pair of opposed side surfaces 84*b* extending longitudinally from the rear surface 84*a*. The material reducer 84 further has a pair of front surfaces 84*c* extending longitudinally and inwardly toward each other at an angle such as thirty-two degrees (32°) to a planar tip surface 84*d*. The planar tip surface 84*d* extends axially or vertically and inwardly at an angle such as two degrees (2°). The material reducer 84 also has a generally planar bottom surface 84*e* and an arcuate or convex top surface 84*f*. The material reducer 84 is disposed in the cavity 83 such that the rear surface 84*a* contacts the side wall 83*b* and the bottom surface 84*e* contacts the base wall 83*a*. The material reducer 84 has a lateral width less than a lateral width of the side wall 83*b* of the cavity 83. The material reducer 84 is attached to the head 78 by suitable means such as brazing. The material reducer 84 is made of a carbide metal. It should be appreciated that, in other embodiments, the material reducer 84 is a cutter to cut and reduce the material.

Referring to FIGS. 3 through 7, the fan 80 is disposed radially below the material reducer 84. The fan 80 is generally rectangular in shape. The fan 80 has a width greater than the height thereof. Preferably, the fan 80 is disposed radially one half inch back or inward from an outer periphery of the material reducer 84 to provide one inch of clearance between the fan 80 and an inner surface of the housing 32 of the rotor assembly 30.

The shaft 82 is disposed opposite the fan 80 and extends outwardly therefrom. The shaft 82 extends axially through the aperture 58 in the first arm 56 and is removably secured to the first arm 56 by a suitable mechanism such as a nut 86 threadably engaging the shaft 82. It should be appreciated that the fan 80 is not a cutting tooth and does not reduce the material, but aggressively outputs the reduced material. It should also be appreciated that the material reducers 84 are typically one inch apart axially and the fans 80 are typically two inches wide axially to cover a space between the material reducers 84. It should further be appreciated that the fan 80 may have any suitable shape or area to push reduced material for aggressive output thereof. It should still further be appreciated that the aggressive output of the fan 80 assists in reducing wear to other components of the rotor assembly 30.

The multi-functional tool 76 includes a tab 87 extending from the head 78 and behind the fan 80. The tab 87 is generally rectangular in shape. The tab 87 has a width less than a width of the head 78. The tool holder 52 may include a slot (not shown) in the first arm 56 to receive the tab 87 to orientate the multi-functional tool 76 and prevent rotation of the multi-functional tool 76 by locking it in place. In another embodiment, the tool holder 52 may include a pair of spaced tabs (not shown) extending outwardly from the first arm 56 to receive the tab 87 therebetween to orientate the multi-functional tool 76 and prevent rotation of the multi-functional tool 76 by locking it in place. The head 78, fan 80, shaft 82, and tab 87 are made of a metal material and are made as a single forging. It should be appreciated that the head 78, fan 80, shaft 82, and tab 87 are a monolithic structure being integral, unitary, and one-piece.

Referring to FIGS. 2 through 4, the processing tool 50 also a raker assembly, generally indicated at 88, attached to the second arm 60. The raker assembly 88 may be fixed or removable from the second arm 60. In the embodiment illustrated, the raker assembly 88 is removable and replaceable. The raker assembly 88 includes a raker 90 disposed in a recess 92 on a forward side of a free end of the second arm 60. The recess 92 is generally rectangular in shape and has a lower surface 94 and a side surface 96. The raker 90 includes a raker wear bar 98 disposed in the recess 92. The raker wear bar 98 is generally rectangular in shape. The raker wear bar 98 is of such a length to extend outwardly beyond a radial end surface 100 of the second arm 60 when disposed in the recess 92. The raker wear bar 98 rests against and is supported by the lower surface 94 and side surface 96. The raker wear bar 98 has an aperture 102 extending axially therein for a function to be described. The raker wear bar 98 is made of a metal material such as a one-piece hard faced material such as Trimay.

The raker assembly 88 also includes another recess 108 on a rear side of a free end of the second arm 60 opposite the recess 92. The recess 108 is generally rectangular in shape. The raker assembly 88 includes an aperture 110 extending from the recess 1 08 to the recess 92 in the second arm 60. The raker assembly 88 further includes a fastener such as a bolt 112 to removably secure the raker wear bar 98 to the second arm 60. The bolt 112 has a head 114 disposed in the recess 108 and a threaded shaft 116 extending axially from the head 114 and through the aperture 110 in the second arm 60 and threadably engaging the threads of the aperture 102 in the raker wear bar 98. The bolt 112 is of a sufficient length to extend through the second arm 60 and into the raker wear bar 98 in an unobstructed manner without penetrating the front face of the raker wear bar 98. It should be appreciated that the second arm 60 operates as a depth-limiting guide.

The processing tool 50 may include at least one notch 118 in the tool holder 52 to control breakage of the processing tool 50. Preferably, the processing tool 50 includes a first notch 118 in the body 54 adjacent to the first arm 56 between the first arm 56 and second arm 60 on a radial outer side thereof and a second notch 118 in the body 54 adjacent to the second arm 60 between the first arm 56 and second arm 60 on a radial inner side thereof. The notches 118 extend axially across the body 54 of the tool holder 52. The notches 118 are generally arcuate in shape and have a depth of approximately one-quarter inches (0.25 inches). The position, shape, and depth of the notches 118 are varied to control breakage of the tool holder 52 relative to either the first arm 56 or second arm 60 of the tool holder 52.

In operation, the rotor 40 rotates the processing tools 50. The multi-functional tool assembly 74 contacts material or product, such as wood, first approximately three revolutions before the raker wear bar 98 contacts the material or product. The material reducer 84 splits the material to reduce the material and the fan 80 pushes the reduced material toward the screens 36,38 of the rotor assembly 30. If the material is stuck or lodged by the multi-functional tool assembly 74 in the material processing machine 10, the first arm 56 will concentrate stress on the tool holder 52 in the notch 118 adjacent to the first arm 56 and cause a breakage by propagating a crack from the notch 118 radially across the body 54 of the tool holder 52. As such, the first arm 56 will then pivot about the bolt 68, which acts as a first pivot pin and remains attached to the mounting arms 46 to prevent damage to the rotor assembly 30. In addition, the remainder of the tool holder 52 including the body 54 and second arm 60 will pivot about the other bolt 68, which acts as a second pivot pin and remains attached to the mounting arms 46 to prevent damage to the rotor assembly 30. The tool holder 52 can then be replaced. It should be appreciated that the multi-functional tool assembly 74 aggressively intakes the material, reduces the material, and aggressively outputs the reduced material from the rotor assembly 30.

During operation, if the material reducer 84 becomes worn due to contact with the material, the material reducer 84 may be removed by unsoldering or unbrazing the material reducer 84 from the head 78 of the multi-functional tool 76. The worn material reducer 84 can be discarded and replaced with a new material reducer 84. The material reducer 84 is disposed in the cavity 83 and soldered or brazed to the head 78 of the multi-functional tool 76 to secure the material reducer 84 in place.

During operation, if the raker wear bar 98 becomes worn due to contact with the material, the bolt 112 may be removed by unthreading the threaded shaft 116 from the raker wear bar 98. The worn raker wear bar 98 can be discarded and replaced with a new raker wear bar 98. The bolt 112 is then threaded with the threads of the aperture 102 to secure the raker wear bar 98 in place.

Referring to FIGS. 8 through 10, another embodiment, according to the present invention, of the multi-functional tool assembly 74 is shown. Like parts of the multi-functional tool assembly 174 have like reference numerals increased by one hundred (100). In this embodiment, the multi-functional tool assembly 174 is attached to the tool holder 52. The multi-functional tool assembly 174 includes a multi-functional tool 176 to aggressively intake the material, reduce the material, and aggressively output the reduced material by pushing the reduced material to the screens 36,38 and out of the rotor assembly 30.

The multi-functional tool 176 includes a head 178, fan 180, and shaft 182. The head 178, fan 180, and shaft 182 are made of a metal material and are made as a single forging. The head 178, fan 180, and shaft 182 are a monolithic structure being integral, unitary, and one-piece.

The multi-functional tool assembly 174 includes a cavity or pocket, generally indicated at 183, between the head 178 and the fan 180 to receive a material reducer 184 to be described. The cavity 183 includes a base wall 183*a*, which is generally planar, and extends laterally and longitudinally. The cavity 183 also includes a side wall 183*b*, which is generally arcuate in shape such as concave, and extending vertically or generally perpendicular to the base wall 183*a*. It should be appreciated that the cavity 183 is formed by a mill (not shown) that plunges into the forging in a secondary machining operation to machine the cavity 183 therein.

The multi-functional tool assembly 174 includes a material reducer, generally indicated at 184, disposed in the cavity 183. The material reducer 184 is a cutter to cut or reduce the material. The material reducer 184 has a rear surface 184*a* that is arcuate in shape such as convex and extending laterally. The material reducer 184 also has a pair of opposed side surfaces 184*b* extending longitudinally from the rear surface 184*a*. The material reducer 184 also has a generally planar front surface 184*c* extending laterally between the side surfaces 184*b*. The material reducer 184 further has a generally planar bottom surface 184*e* and an arcuate or convex top surface 184*f*. The material reducer 184 is disposed in the cavity 183 such that the rear surface 184*a* contacts the side wall 183*b* and the bottom surface 184*e* contacts the base wall 183*a*. The material reducer 184 has a lateral width greater than a lateral width of the side wall 183*b* of the cavity 183. The material reducer 184 is attached to the head 178 by suitable means such as brazing. The material reducer 184 is made of a carbide material.

The multi-functional tool 176 includes a tab 187 extending from the head 178 and behind the fan 180. The tab 187 is generally rectangular in shape. The tab 187 has a width less than a width of the head 178. The tool holder 152 may include a slot (not shown) in the first arm 156 to receive the tab 187 to orientate the multi-functional tool 176 and prevent rotation of the multi-functional tool 176 by locking it in place. In another embodiment, the tool holder 152 may include a pair of spaced tabs (not shown) extending outwardly from the first arm 156 to receive the tab 187 therebetween to orientate the multi-functional tool 176 and prevent rotation of the multi-functional tool 176 by locking it in place. The head 178, fan 180, shaft 182, and tab 187 are made of a metal material and are made as a single forging. It should be appreciated that the head 178, fan 180, shaft 182, and tab 187 are a monolithic structure being integral, unitary, and one-piece.

In operation, the rotor 40 rotates the processing tool 50. The multi-functional tool assembly 174 contacts material or product, such as wood, first approximately three revolutions before the raker wear bar 98 contacts the material or product. The waste reducer 184 cuts the material to reduce the material and the fan 180 pushes the reduced material toward the screens 36,38 of the rotor assembly 30. It should be appreciated that the multi-functional tool assembly 174 aggressively intakes the material, reduces the material, and aggressively outputs the reduced material from the rotor assembly 30.

During operation, if the material reducer 184 becomes worn due to contact with the material, the material reducer 184 may be removed by unsoldering or unbrazing the material reducer 184 from the head 178 of the multi-functional tool 176. The worn material reducer 184 can be discarded and replaced with a new material reducer 184. The material reducer 184 is disposed in the recess 183 and soldered or brazed to the head 178 of the multi-functional tool 176 to secure the material reducer 184 in place.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A multi-functional tool assembly for a material processing machine comprising:

a single tool including a head and a shaft integrally formed therein, said head having a cavity with an arcuate surface; and a material reducer adapted to reduce material within the material processing machine, said material reducer being disposed in said cavity and having an arcuate surface complementary to said arcuate surface of said cavity;

wherein said single tool includes a fan disposed radially below said material reducer to aggressively output reduced material from the material processing machine.

2. A multi-functional tool assembly as set forth in claim 1 wherein said arcuate cavity has a side wall that is generally arcuate in shape to form said arcuate surface and a base wall that is generally planar in shape.

3. A multi-functional tool assembly as set forth in claim 1 wherein said material reducer is a cutter made of a carbide material for cutting material.

4. A multi-functional tool assembly as set forth in claim 1 wherein said material reducer has a generally arcuate rear surface, opposed side surfaces extending from said rear surface, and a generally planar front surface extending from said side surfaces.

5. A multi-functional tool assembly as set forth in claim 1 wherein said material reducer has a lateral width greater than a lateral width of said side wall of said cavity.

6. A multi-functional tool assembly as set forth in claim 1 wherein said material reducer is a splitter made of a carbide material for splitting material.

7. A multi-functional tool assembly as set forth in claim 1 wherein said material reducer has a generally arcuate rear surface, opposed side surfaces extending from said rear surface, and a pair of front surfaces extending from said side surfaces, and a generally planar tip surface extending between said front surfaces.

8. A multi-functional tool assembly as set in claim 1 wherein said material reducer has a lateral width less than a lateral width of said side wall of said cavity.

9. A multi-functional tool assembly as set forth in claim 1 including brazing to attach said material reducer to said head.

10. A processing tool for a material processing machine comprising:

a tool holder for attachment to a rotor assembly of the material processing machine; and a single multi-functional tool assembly attached to said tool holder to reduce material comprising a material reducer to reduce material and a single tool to support said material reducer, said tool including a head, a fan, and a shaft integrally formed therein, said head having an arcuate cavity to receive said material reducer and said material reducer having an arcuate surface complementary to a surface of said arcuate cavity.

11. A processing tool as set forth in claim 10 wherein said fan is disposed radially below said material reducer to aggressively output reduced material from the material processing machine.

12. A processing tool as set forth in claim 10 wherein said arcuate cavity has a side wall that is generally arcuate in shape and a base wall that is generally planar in shape.

13. A processing tool as set forth in claim 12 wherein said material reducer is a cutter made of a carbide material for cutting material.

14. A processing tool as set forth in claim 12 wherein said material reducer has a generally arcuate rear surface, opposed side surfaces extending from said rear surface, and a generally planar front surface extending from said side surfaces.

15. A processing tool as set forth in claim 12 wherein said material reducer has a lateral width greater than a lateral width of said side wall of said cavity.

16. A processing tool as set forth in claim 12 wherein said material reducer is a splitter made of a carbide material for splitting material.

17. A processing tool as set forth in claim 12 wherein said material reducer has a generally arcuate rear surface, opposed side surfaces extending from said rear surface, and a pair of front surfaces extending from said side surfaces, and a generally planar tip surface extending between said front surfaces.

18. A processing tool as set forth in claim 12 wherein said material reducer has a lateral width less than a lateral width of said side wall of said cavity.

19. A processing tool as set forth in claim 10 including brazing to attach said material reducer to said head.

20. A material processing machine comprising:

a rotor assembly;

at least one tool holder attached to said rotor assembly, wherein said at least one tool holder includes a first arm extending radially and a second arm extending radially and spaced from said first arm; and a single multi-functional tool assembly comprising a material reducer to reduce material and a single tool to support said material reducer, said tool including a head, a fan, and a shaft integrally formed therein, said head having an arcuate cavity to receive said material reducer and said material reducer having an arcuate surface complementary to a surface of said arcuate recess, said fan being disposed radially below said material reducer to aggressively output the reduced material from said rotor assembly and shall being disposed opposite said fan and extending outwardly away therefrom and attached to either one of said first arm and said second arm of said tool holder.

* * * * *

UNITED STATES PATENT AND TRADEMARK OFFICE

CERTIFICATE OF CORRECTION

PATENT NO. : 7,726,594 B2
APPLICATION NO. : 11/702452
DATED : June 1, 2010
INVENTOR(S) : Leward Nile Smith It is certified that error appears in the above-identified patent and that said Letters Patent is hereby corrected as shown below:

Col. 10, claim 20, line 30 "shall" should read --shaft--

Signed and Sealed this

Nineteenth Day of October, 2010

David J. Kappos

David J. Kappos
*Director of the United States Patent and Trademark Office*